US009895734B2

(12) United States Patent
Groβerüschkamp et al.

(10) Patent No.: US 9,895,734 B2
(45) Date of Patent: Feb. 20, 2018

(54) DEVICE FOR PRODUCING AT LEAST ONE UNDERCUT IN A SLOTTED OR CLOSED PROFILED SHEET SECTION

(71) Applicant: THYSSENKRUPP STEEL EUROPE AG, Duisburg (DE)

(72) Inventors: Thomas Groβerüschkamp, Duisburg (DE); Thomas Flöth, Duisburg (DE); Michael Brüggenbrock, Rosendahl (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 0 days.

(21) Appl. No.: 14/897,635

(22) PCT Filed: May 2, 2014

(86) PCT No.: PCT/EP2014/058975
§ 371 (c)(1),
(2) Date: Dec. 10, 2015

(87) PCT Pub. No.: WO2014/202271
PCT Pub. Date: Dec. 24, 2014

(65) Prior Publication Data

US 2016/0121383 A1 May 5, 2016

(30) Foreign Application Priority Data

Jun. 17, 2013 (DE) ..... 10 2013 106 287

(51) Int. Cl.
*B21D 31/00* (2006.01)
*B21D 13/04* (2006.01)
(Continued)

(52) U.S. Cl.
CPC ..... *B21D 13/04* (2013.01); *B21D 5/015* (2013.01); *B21D 53/88* (2013.01)

(58) Field of Classification Search
CPC ..... B21D 17/02; B21D 13/04; B21D 5/015; B21D 53/88
(Continued)

(56) References Cited

U.S. PATENT DOCUMENTS 805,868 A * 11/1905 Marshall ..... B21D 39/20 72/393
3,459,028 A * 8/1969 Bijvoet ..... B21D 51/2646 413/1
(Continued)

FOREIGN PATENT DOCUMENTS

CN 101352741 A 1/2009
CN 201969761 U 9/2011
(Continued)

OTHER PUBLICATIONS

German Language International Search Report for International patent application No. PCT/EP2014/058975; dated Oct. 30, 2014.
(Continued)

*Primary Examiner* — David B Jones
(74) *Attorney, Agent, or Firm* — thyssenkrupp North America, Inc.

(57) ABSTRACT

A device for manufacturing at least one undercut in a sheet-metal profile that is slotted or closed may include an inner core portion and an outer core portion, which together can be inserted within the sheet-metal profile and/or may support a semi-finished sheet-metal product from which the sheet-metal profile is formed. The inner core portion and the outer core portion may have faces that mate with one another such that when the inner core portion rotates or translates relative to the outer core portion, the outer core portion is forced away from the inner core portion. To cause this behavior, the faces may be undulating, inclined, or cam-like, for example. In effect, a cross-sectional profile of the device may be reduced at least for purposes of extracting the device
(Continued)

from the sheet-metal profile after the undercuts have been formed.

5 Claims, 4 Drawing Sheets

(51) Int. Cl.
*B21D 5/01* (2006.01)
*B21D 53/88* (2006.01)

(58) Field of Classification Search
USPC ..... 72/393
See application file for complete search history.

(56) References Cited

U.S. PATENT DOCUMENTS

| | | | | |
|---|---|---|---|---|
| 3,877,282 | A * | 4/1975 | Pogonowski | B21D 39/046 249/184 |
| 5,943,891 | A * | 8/1999 | Takagi | B21C 37/108 72/393 |
| 2002/0162297 | A1 | 11/2002 | Graber et al. | |
| 2009/0114703 | A1 | 5/2009 | Bruggenbrock et al. | |
| 2013/0086968 | A1 | 4/2013 | Shimai | |

FOREIGN PATENT DOCUMENTS

| | | | |
|---|---|---|---|
| CN | 103028783 | A | 4/2013 |
| DE | 91 02 285 | U1 | 5/1991 |
| DE | 10 2004 046 687 | B3 | 6/2006 |
| DE | 102008049245 | A1 | 4/2010 |
| DE | 10 2008 064 320 | A1 | 6/2010 |
| EP | 1 210 999 | A1 | 6/2002 |
| EP | 2 355 942 | B1 | 1/2013 |
| JP | S59 220225 | A | 12/1984 |
| WO | 96/20798 | A1 | 7/1996 |

OTHER PUBLICATIONS

English translation of International Search Report for International patent application No. PCT/EP2014/058975; dated Oct. 30, 2014.
English translation of the abstract of JP S59 220225 A.
English language machine translation of DE 91 02 285 U1.
English translation of the abstract of EP 2 355 942 B1.
English translation of the abstract of EP 1 210 999 A1.
English translation of the abstract of DE 10 2008 064 320 A1.
English language Abstract for CN101352741A listed above.
English language Abstract for DE102008049245A1 listed above.
English language Abstract for CN201969761U listed above.

* cited by examiner

DEVICE FOR PRODUCING AT LEAST ONE UNDERCUT IN A SLOTTED OR CLOSED PROFILED SHEET SECTION

CROSS REFERENCE TO RELATED APPLICATIONS

This application is a U.S. National Stage Entry of International Patent Application Serial Number PCT/EP2014/058975, filed May 2, 2014, which claims priority to German Patent Application No. DE 102013106287.3 filed Jun. 17, 2013, the entire contents of both of which are incorporated herein by reference.

FIELD

The present disclosure relates to devices for manufacturing undercuts in sheet metal having slotted or closed profiles.

BACKGROUND

In the manufacture of profiles which are at least in part closed (slotted profiles) or of such semi-finished products continuous or discontinuous forming methods may be used. Continuous forming is performed by roll forming, for example. Discontinuous methods are preferred when continuous roll forming cannot be applied on account of a complex profile or semi-finished product geometry. So-called U-O forming, for example, is known in the discontinuous manufacture of profiles or semi-finished products which are at least in part closed.

The prior art also includes the manufacture of three-dimensionally shaped components of sheet metal by way of the progressive die method (see, for example, US 2002/0162297 A1, FIGS. 6 to 8).

In the automotive industry, closed profiles from sheet metal are used as structural components, for example as bumpers and shock-absorbing hollow sections. Occasionally there is also demand for slotted or closed sheet-metal profiles which have undercuts, such as, for example, pleats, embossings, elevations, or similar shaped elements which run transversely to the longitudinal axis of a hollow section. In the case of a crash, such undercuts may serve to increase the rigidity of the component and/or to influence the behavior under deformation, for example.

Manufacturing subsidiary shaped elements, such as pleats or similar embossings, in longitudinal welded hollow profiles by means of a mandrel which is disposed in the hollow profile produced from a sheet metal blank is proposed in DE 10 2004 046 687 B3 (see para. [0032] therein). The mandrel in this case has an embossing installation for embossing the sheet metal which is wrapped around said mandrel. Such a mandrel may also have subsidiary structures for embossing which are not constant in terms of length, provided there is the possibility for the mandrel to be removed after forming, this being the case with a conical basic structure, for example. In order to be able to also configure shaped elements of comparatively large volumes in a reliable manner, the embossing installation for this purpose may be configured as an embossing die which is displaceable beyond the circumference of the mandrel, and shaping elements as counterparts to the shaping which is produced by the embossing installation may be provided in clearances of the die halves which enclose the mandrel.

However, the proposal disclosed in DE 10 2004 046 687 B3 is not, or is hardly suitable for manufacturing substantially cylindrical hollow profiles having undercuts, in particular inwardly oriented undercuts, since the described mandrel cannot, once the undercut has been embossed, be removed from the closed hollow profile again in such cases.

SUMMARY

One of the primary objects of the present disclosure is to provide a device which in a simple manner enables cost-effective manufacturing of undercuts in a slotted or closed sheet-metal profile.

This object is achieved according to the invention by a device having the features of claim 1. Further advantageous embodiments of the device according to the invention can be derived from the dependent claims.

The device according to the invention comprises a core which is inserted into the slotted or closed sheet-metal profile or serves as a support core for a semi-finished sheet-metal product from which the slotted or closed sheet-metal profile is produced, and is furthermore characterized in that the core has at least two outer core portions of which at least one has at least one depression or at least one protrusion for shaping an undercut in the sheet-metal profile, and that an inner core portion which is movable in relation to the outer core portions and has at least one active face which in a predefined movement direction of the inner core portion is configured so as to be inclined or cam-shaped in relation to the outer core portion, is disposed between the at least two outer core portions, wherein by moving the inner core portion in the predefined movement direction in relation to the outer core portions the latter are made to diverge and subsequently, by moving the inner core portion in the opposite movement direction, the latter are made to converge.

Slotted and also closed sheet-metal profiles having undercuts may be manufactured in a cost-effective manner using the device according to the invention.

One advantageous embodiment of the device according to the invention is characterized in that the inner core portion is displaceable in a linear manner in relation to the outer core portions. This embodiment corresponds particularly well to the operational steps in a transfer or line process, such that a core unit which is configured according to the invention may be integrated into such a process in a comparatively simple and reliable manner. The core unit which is subdivided into the outer core portions and the inner core portions may also be referred to as a collapsible core.

One further advantageous embodiment of the device according to the invention is characterized in that the active face of the inner core portion is configured so as to be undulated, wherein at least one of the outer core portions has an inner face which is assigned to the active face and which is likewise configured so as to be undulated. As a result, parallel and stepless diverging and subsequent converging of the outer core portions may be implemented in a very reliable manner. In particular, support faces which are defined by the outer core portions and the inner core portion may be kept substantially flush with one another even as the outer core portions diverge.

One further advantageous embodiment of the device according to the invention provides that the active face of the inner core portion is embodied in duplicate, wherein the two active faces are configured on opposite sides of the inner core portion, and wherein the outer core portions in each case have an inner face which is configured so as to be undulated and which is assigned to one of the active faces of the inner core portion. As a result, relatively wide spreading of the outer core portions may be brought about by a relatively minor linear displacement of the inner core portion.

According to one further advantageous embodiment of the device according to the invention, the outer core portions are held on a mounting so as to be movable, wherein the mounting has an opening which is penetrated by the inner core portion. This embodiment simplifies handling of the three core portions mentioned. The mounting here is preferably provided with a guide for the outer core portions which are held thereon so as to be movable. This contributes toward reliable functioning of the core unit which is constructed from the core portions mentioned. Moreover, the arrangement of the guide on the mounting is favorable to a compact construction of the device according to the invention, in particular to the core unit mentioned.

One further advantageous embodiment of the device according to the invention is characterized in that the inner core portion is displaceable counter to the effect of at least one compression spring in the predefined movement direction in relation to the outer core portions, wherein the compression spring is supported on the mounting. As a result, resetting (reversed displacement) of the inner core portion in relation to the outer core portions and, conjointly therewith, resetting (i.e. converging) of the outer core portions is brought about in a simple and reliable manner when the core unit, after the manufacture of the at least one undercut in the slotted or closed sheet-metal profile, has to be withdrawn therefrom again. To this end the inner core portion may advantageously be fastened to a compression body which has at least one opening which is penetrated by a guide bar, wherein the guide bar is fastened to said mounting in this case. Furthermore, the guide bar here may be disposed in the compression spring such that the latter is radially supported on the guide bar. The spring force of the compression spring or compression springs here is chosen so as to be higher than the friction forces which have to be overcome for the inner core portion to be reset in a self-acting manner in relation to the outer core portions.

In one particularly preferable embodiment of the device according to the invention, the outer core portions are moveable in a linear manner together with the inner core portion, wherein the outer core portions are assigned to an end stop, and wherein the inner core portion is moved onward in the predefined movement direction in relation to the outer core portions when the outer core portions are forced against the end stop. As a result of this embodiment, the device according to the invention is further improved in terms of simple and reliable functioning and of integration into a transfer or line process.

According to one further embodiment of the invention, the end stop mentioned is provided with a guide for the outer core portions for when the latter are made to diverge and to subsequently converge. This guide allows reliable functioning of the device according to the invention in a transfer or line process to be further optimized. This guide is preferably formed from a web-shaped guide element which has a cross-sectional profile which tapers off in the direction of the outer core portions, wherein clearances for receiving the guide element are configured in those end sides of the outer core portions and of the inner core portion that face the guide element. The guide element at the same time serves for locking the outer core portions and the inner core portion.

Particularly reliable locking of the outer core portions and of the inner core portion results when the end stop according to one further preferable embodiment has mutually facing stop faces which delimit the diverging movement of the outer core portions.

DETAILED DESCRIPTION

Figure 1:
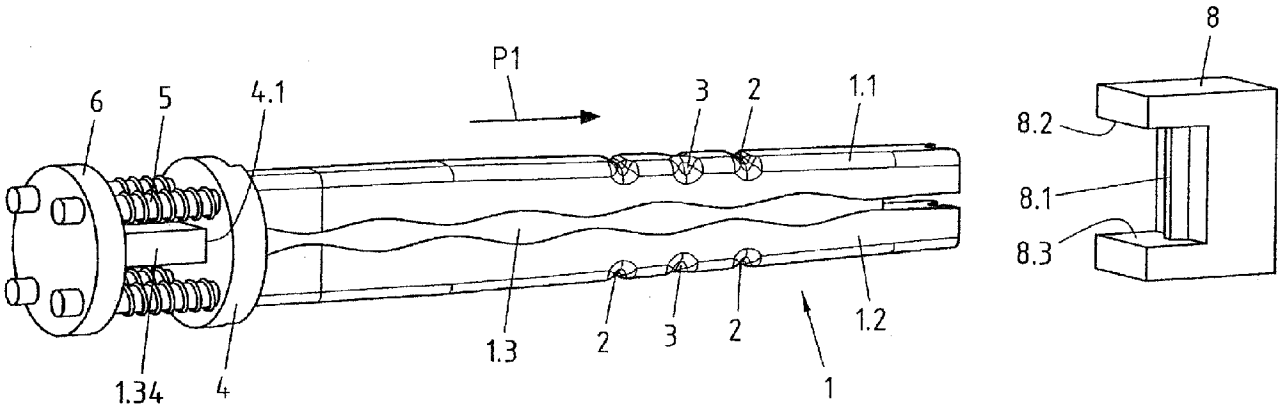
FIG. 1 is a perspective view of an example core unit in a starting position with coils that are largely relaxed.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The device illustrated in the drawing serves for manufacturing undercuts in a slotted or closed hollow profile which is made from sheet metal. The device comprises a threepart core 1 which may also be referred to as a core unit or as a collapsible core.

The core unit 1 is configured so as to be elongate and comprises two outer core portions 1.1, 1.2 which have in each case a plurality of depressions 2, 3 for shaping inwardly oriented undercuts in a closed sheet-metal profile, for example. An inner core portion 1.3 which is displaceable in a linear manner in relation to the outer core portions 1.1, 1.2 and has undulated active faces 1.31, 1.32 is disposed between the two outer core portions 1.1, 1.2. Those inner faces 1.11, 1.21 of the outer core portions 1.1, 1.2 that face the active faces 1.31, 1.32 of the inner core portion 1.3 are likewise configured so as to be undulated. The undulated active faces 1.31, 1.32 of the inner core portion 1.3, and the inner faces 1.11, 1.21 of the outer core portions 1.1, 1.2 are preferably configured so as to be mutually substantially complementary. The three core portions 1.1, 1.2, 1.3 have substantially identical widths or depths, respectively, such that the lateral faces of the collapsible core 1, which run parallel with one another, have lateral part faces 1.12, 1.22, 1.33 which are in each case disposed so as to and be mutually flush.

By displacing the inner core portion 1.3 in a linear manner in the movement direction which is indicated by the arrow P1 in FIG. 1 in relation to the outer core portions 1.1, 1.2, the core unit 1 is spread, as a result account of which the outer core portions 1.1, 1.2 are made to diverge.

The depressions 2, 3 for shaping inwardly oriented undercuts in the slotted or closed sheet-metal profile are disposed on that outer side of the respective outer core portion 1.1, 1.2 that faces away from the inner core portion 1.3. The depressions 2, 3 are configured so as to be channel-shaped, for example, and run transversely to the longitudinal axis of the collapsible core (core unit) 1. The depressions 2, 3 may furthermore also be configured in the shape of dents or calottes.

Figure 6:
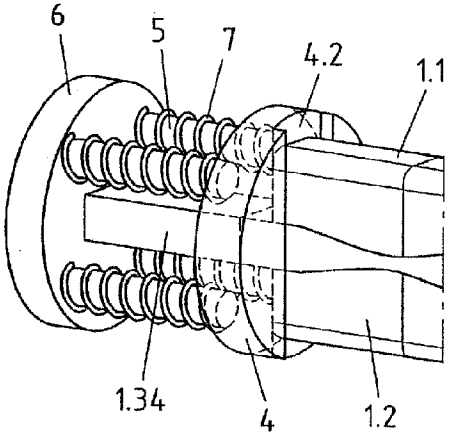
FIG. 6 is partial perspective view of the example core unit of FIG. 1 showing a core mounting plate on which an outer core portions are guided.

The outer core portions 1.1, 1.2 by way of one of the ends thereof are held on a plate-shaped mounting 4 so as to be movable. The mounting (core mounting plate) 4 has a through opening 4.1 which is penetrated by a substantially straight portion 1.34 of the inner core portion 1.3. The straight portion 1.34 of the inner core portion has a substantially rectangular cross section, for example, wherein the through opening 4.1 of the core mounting plate 4 has a corresponding cross-sectional profile and serves as a guide. The core mounting plate 4 on that side which faces the outer core portions 1.1, 1.2 is provided with a guide 4.2 for the outer core portions 1.1, 1.2 (see FIG. 6). The guide 4.2 is configured so as to be groove-shaped and intersects the through opening 4.1.

Guide bolts (guide bars) 5 which run parallel with one another are attached on that side of the core mounting plate 4 that faces away from the outer core portions 1.1, 1.2. The guide bolts 5 extend parallel with respect to the longitudinal axis of the collapsible core (core unit) 1 and are guided (through bore 6.1) in a plate-shaped compression body (compression plate) 6. The compression plate 6 is fixedly connected, for example welded or screwed, to the end of the straight portion of the inner core portion 1.3. The guide bolts 5 are provided with compression springs (coil springs) 7 which are disposed between the core mounting plate 4 and the compression plate 6 and which are push-fitted onto the guide bolts 5.

The outer core portions 1.1, 1.2 are moveable in a substantially linear manner together with the inner core portion 1.3, wherein the core portions 1.1, 1.2, 1.3 are assigned an end stop 8. In the position of the collapsible core 1 illustrated in FIG. 2, the outer core portions 1.1, 1.2 by way of the end thereof that faces away from the core mounting plate 4 abut the end stop 8, wherein that end of the inner core portion 1.3 that faces away from the core mounting plate 4 is (initially) located so as to be considerably spaced apart from the end stop 8. If the inner core portion 1.3 is now moved onward in the direction of the end stop 8 by further displacement of the compression plate 6, while compressing the compression springs 7, in relation to the outer core portions 1.1, 1.2, the outer core portions 1.1, 1.2, on account of the undulated inner faces 1.11, 1.21 thereof and of the undulated active faces 1.31. 1.32 of the inner core portion 1.3, are made to diverge. In FIG. 3 this is indicated by the mutually opposed arrows P2, P3.

The end stop 8 is provided with a guide 8.1 for the outer core portions 1.1, 1.2. The guide 8.1 is configured as a web-shaped guide element which has a cross-sectional profile, for example a trapezoidal profile, which tapers off in the direction of the outer core portions 1.1, 1.2. Clearances 1.13, 1.23, 1.35 for receiving the guide element 8.1 are configured in those end sides of the outer core portions 1.1, 1.2 and of the inner core portion 1.3 that face the guide element 8.1. The guide element 8.1 at the same time serves for locking the core portions 1.1, 1.2, 1.3. The end stop 8 furthermore has mutually facing stop faces 8.2, 8.3 which delimit the diverging movement of the outer core portions 1.1, 1.2.

The functional concept of the collapsible core according to the invention will be briefly explained again by means of FIGS. 1 to 5.

A starting position in which the compression springs 7 are largely relaxed and the threepart core unit (collapsible core) 1 is not spread is illustrated in FIG. 1.

Figure 2:
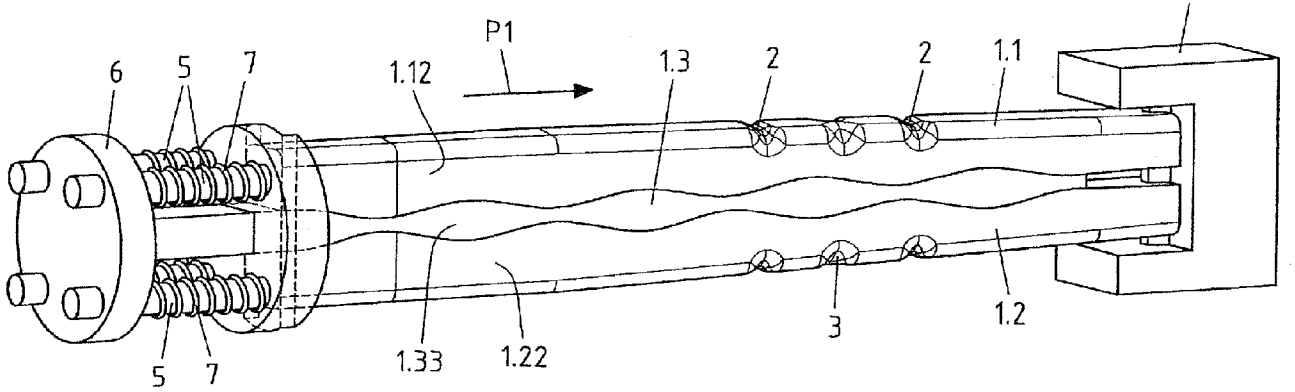
FIG. 2 is a perspective view of the example core unit of FIG. 1 in an intermediate position, after the core unit has been displaced in a linear manner.
Figure 3:
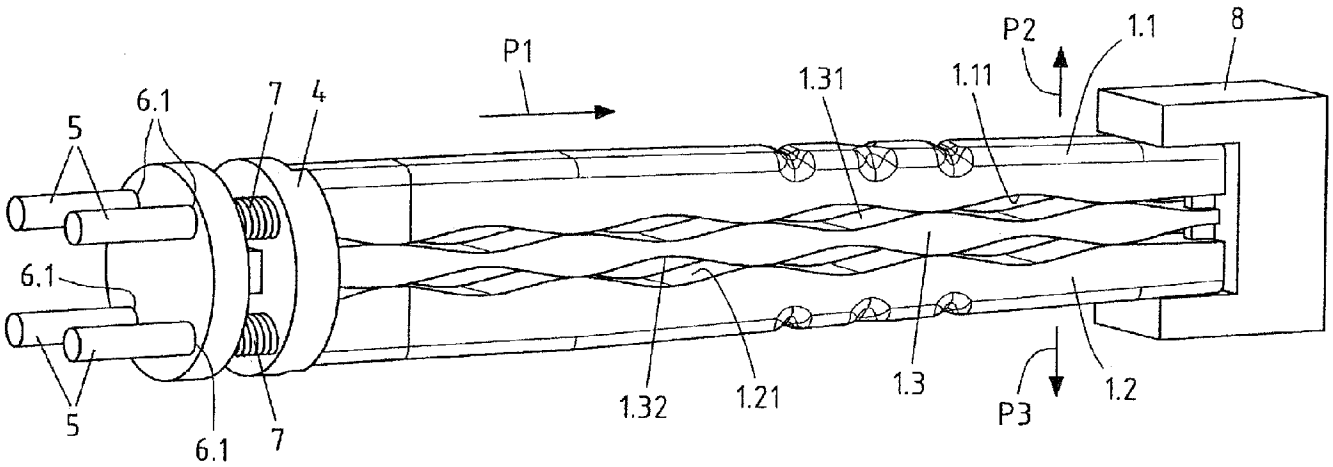
FIG. 3 is a perspective view of the example core unit of FIG. 1 in an end position.

FIG. 2 shows an intermediate position, after the core unit 1 has been displaced in a linear manner in the direction of the end stop 8 and the two outer core portions 1.1, 1.2 by way of that end thereof that faces away from the core mounting plate 4 touch the end stop 8.

An end position which follows on from the intermediate position according to FIG. 2 is illustrated in FIG. 3. In this end position, the compression plate 6 has previously been displaced in a linear manner onward in the direction of the arrow P1, counter to the spring force of the compression springs 7. As a result, displacement of the inner core portion 1.3 has been caused, as a result which the two outer core portions 1.1, 1.2 have been urged to the outside and thus perform a lifting or spreading motion, respectively. The end stop 8 which here is configured in a fork-shaped or U-shaped manner, for example, here likewise serves as a limiter of the lifting or spreading motion, respectively, of the two outer core portions.

Figure 4:
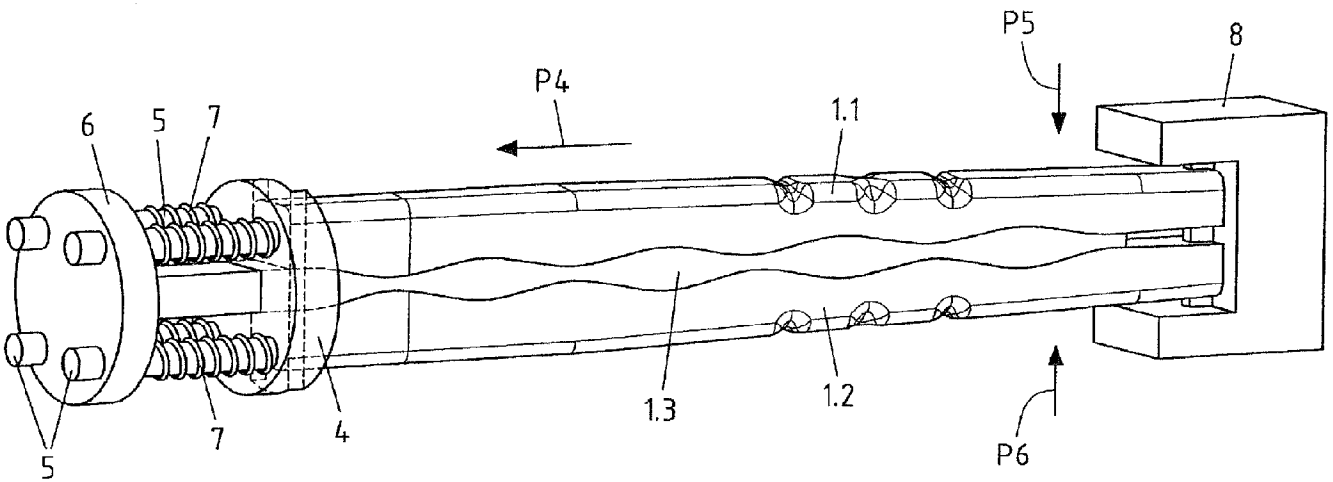
FIG. 4 is a perspective view of an example core unit during a retracting movement, wherein the core unit is being pulled away from an end stop in a linear manner.

A situation during the retracting movement of the core unit 1 is illustrated in FIG. 4. It can be seen that the core unit 1 is being pulled away from the end stop 8 in a linear manner in the direction of the arrow P4, wherein, on account of the previously compressed compression springs 7, the compression plate 6 is first moved together with the inner core portion 1.3, and the two outer core portions 1.1, 1.2 initially remain engaged with the end stop 8. As a result, the inner core portion 1.3 is pulled, and at the same time the total height of the threepart collapsible core 1, or the spacing of the outer core portions 1.1, 1.2, respectively, is reduced, this being additionally indicated in FIG. 4 by the arrows P5 and P6. As a result, the manufacture of closed hollow profiles and slotted profiles having undercuts is possible in a transfer or line process.

Figure 5:
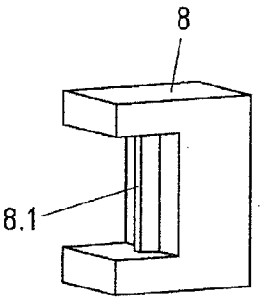
FIG. 5 is a perspective view of an example core unit at the end of an operational cycle, wherein the core unit has been moved away and retracted from an end stop.
Figure 7:
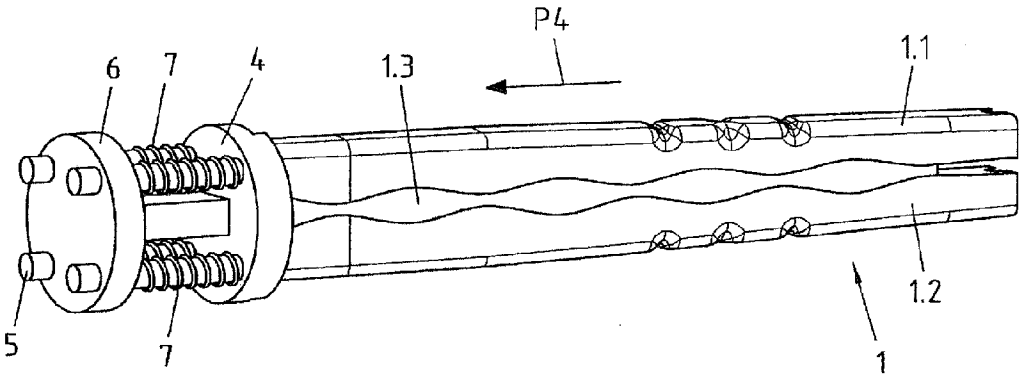
FIG. 7 is an enlarged partial perspective view of a portion of an end of the example core unit of FIG. 1 that is connectable to a terminal stop.
Figure 7:
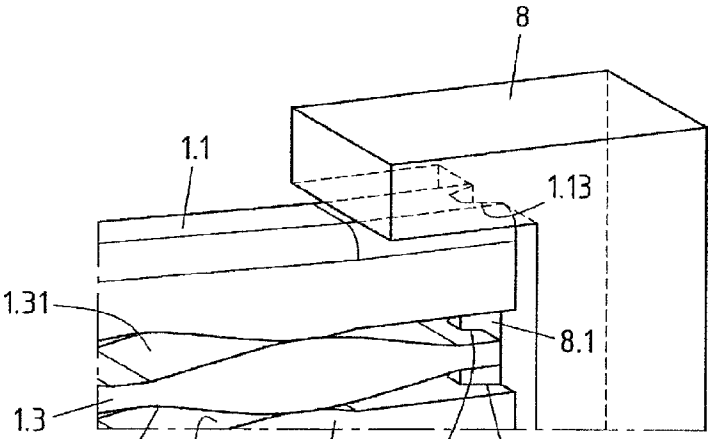

The situation at the end of an operational cycle is illustrated in FIG. 5. After having pulled the inner core portion 1.3, the entire core unit 1 has been moved away and retracted from the end stop 8 (cf. arrow P4). The core unit 1 thus releases the sheet-metal profile which is provided with undercuts for onward conveying in the transfer or line process. The situation according to FIG. 5 corresponds to the starting position illustrated in FIG. 1.

Figure 8:
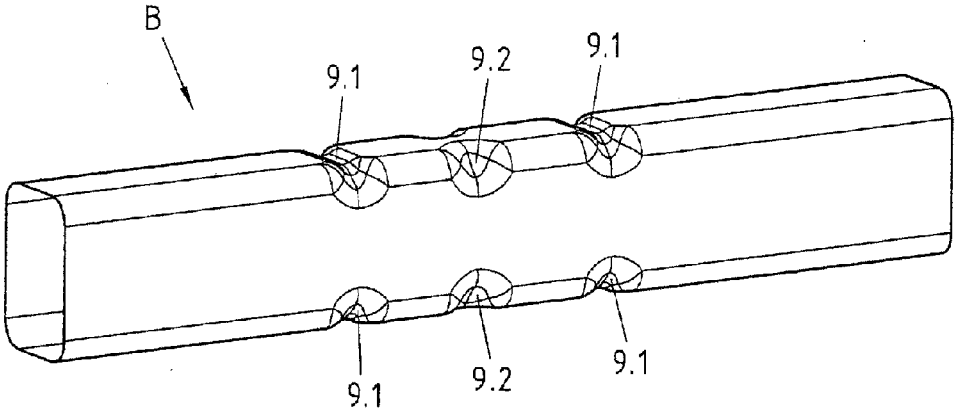
FIG. 8 is a perspective view of an example piece of closed-profile sheet metal into which inwardly oriented undercuts have been manufactured.
Figure 9:
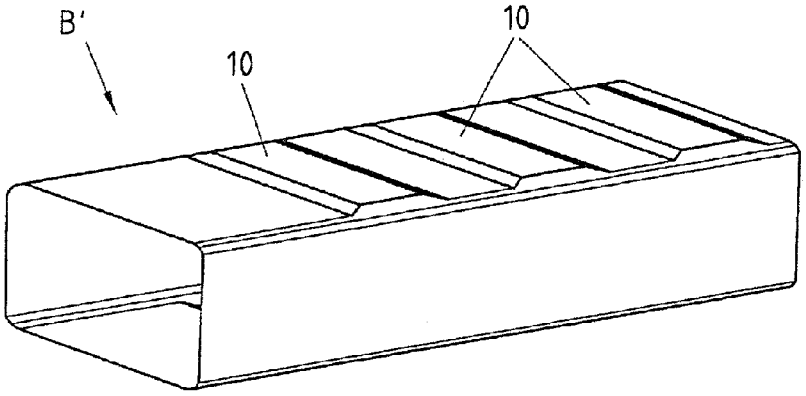
FIG. 9 is a perspective view of an example piece of closed-profile sheet metal into which undercuts have been manufactured.

An example of a closed sheet-metal profile B, which has inwardly oriented undercuts 9.1, 9.2 and which can be manufactured by means of the core unit 1 according to FIGS. 1 to 7, is illustrated in FIG. 8. The undercuts 9.1 are configured in a channel shape or pleat shape, while the undercuts 9.2 are configured in a dent shape. Of course, other geometrical shapes are possible for the hollow profile to be manufactured. In particular, closed sheet-metal profiles B' having outwardly oriented undercuts 10 may also be manufactured using a device according to the invention, as is shown in an exemplary manner in FIG. 9.

The embodiment of the device according to the invention is not restricted to the exemplary embodiments illustrated in the drawing. Rather, numerous variants which also make use of the invention as stated in the appended claims in a design which is modified with respect to the exemplary embodiments are conceivable. For example, it is also conceivable for the diverging (spreading) of the outer core portions 1.1, 1.2 to be performed by means of a rotatable inner core portion (not shown), wherein the latter then has at least one active face which in a predefined rotation direction, namely the rotation direction in relation to the outer core portions 1.1, 1.2, is configured so as to be cam-shaped. The cam-shaped active face, or the cam of the rotatable inner core portion (not shown), respectively, in the non-spread position of the outer core portions here is received with play in a hollow chamber in one of the outer core portions, for example, from where said cam, on account of rotation of the inner core portion, may be pivoted outward and passed against an inner face of the other outer core portion, such that diverging (spreading) of the outer core portions 1.1, 1.2 results from a continuation of this rotation or pivoting movement, respectively.

What is claimed is:

1. A device for manufacturing at least one undercut in a sheet-metal profile that is slotted or closed, the device comprising:

a core that either supports a semi-finished sheet-metal product from which the sheet-metal profile is formed or is insertable within the sheet-metal profile, wherein the core comprises:

a first core outer portion, a second core outer portion, wherein at least one of the first core outer portion or the second core outer portion includes a depression or a protrusion for shaping an undercut in the sheet-metal profile, and an inner core portion that is disposed between and movable relative to the first and second core outer portions, the inner core portion having at least one active face that is either inclined or cam-shaped, wherein moving the inner core portion in a first direction relative to the first and second outer core portions causes the first and second outer core portions to diverge, wherein moving the inner core portion in a second direction opposite the first direction relative to the first and second outer core portions causes the first and second outer core portions to converge; and a mounting on which the first and second outer core portions are movably positioned, the mounting defining an opening there through that is penetrated by the inner core portion, and having at least one guide bar extending therefrom;

a compression spring into which the guide bar is inserted so as to be radially supported on the guide bar;

a compression body coupled to the inner core portion, and defining at least one through bore that is penetrated by the at least one guide bar extending from the mounting.

2. The device of claim 1 wherein the mounting comprises a guide for holding the first and second outer core portions in a manner that prevents movement in the first direction and the second direction but permits the first and second outer core portions to diverge and converge.

3. The device of claim 1, wherein the compression spring is supported on the mounting, wherein moving the inner core portion in the first direction and relative to the first and second outer core portions requires overcoming a force of the compression spring.

4. A device for manufacturing at least one undercut in a sheet-metal profile that is slotted or closed, the device comprising:

a core that either supports a semi-finished sheet-metal product from which the sheet-metal profile is formed or is insertable within the sheet-metal profile, wherein the core comprises:

a first outer core portion having a first clearance defined in a side thereof, a second outer core portion having a second clearance defined in a side thereof, wherein at least one of the first outer core portion or the second outer core portion includes a depression or a protrusion for shaping an undercut in the sheet-metal profile, and an inner core portion having a third clearance defined in a side thereof and having at least one active face that is either inclined or cam-shaped, the inner core portion being disposed between and movable relative to the first and second outer core portions, wherein moving the inner core portion in a first direction relative to the first and second outer core portions causes the first and second outer core portions to diverge, wherein moving the inner core portion in a second direction opposite the first direction relative to the first and second outer core portions causes the first and second outer core portions to converge; and an end stop having a guide configured to receive the first and second outer core portions in a manner that permits the first and second outer core portions to converge and diverge depending on the positioning of the inner core portion, the guide of the end stop comprising a web-shaped guide element having a cross-sectional profile that tapers in a direction of the first and second outer core portions, wherein each of the first, second, and third clearances respectively defined in the side of the first outer core portion, the second outer core portion, and the inner core portion are configured to receive the web-shaped guide element, wherein the first and second outer core portions are moveable in a substantially linear manner together with the inner core portion, wherein the first and second outer core portions selectively mate with the end stop, with the inner core portion being moveable in the first direction relative to the first and second outer core portions when the first and second outer core portions are positioned against the end stop.

5. The device of claim 4 wherein the end stop includes mutually facing stop faces that delimit the divergence of the first and second outer core portions.

* * * * *